US005134981A

United States Patent [19]

Takahashi et al.

[11] Patent Number: 5,134,981

[45] Date of Patent: Aug. 4, 1992

[54] FUEL INJECTION CONTROL METHOD IN AN ENGINE

[75] Inventors: Shinsuke Takahashi, Yokohama; Teruji Sekozawa, Kawasaki; Makoto Shioya, Tokyo, all of Japan

[73] Assignee: Hitachi, Ltd., Chiyoda, Japan

[21] Appl. No.: 575,688

[22] Filed: Aug. 31, 1990

[30] Foreign Application Priority Data

Sep. 4, 1989 [JP] Japan ..... 1-227367

[51] Int. Cl.[5] ..... F02D 41/10; F02D 41/18

[52] U.S. Cl. ..... 123/478; 123/492

[58] Field of Search ..... 123/478, 480, 492, 493

[56] References Cited

U.S. PATENT DOCUMENTS

| | | | |
|---|---|---|---|
| 4,301,780 | 11/1981 | Hoshi | 123/486 |
| 4,357,923 | 11/1982 | Hideg | 123/492 |
| 4,562,814 | 1/1986 | Abo et al. | 123/492 |
| 4,667,640 | 5/1987 | Sekozawa et al. | 123/492 |
| 4,792,905 | 12/1988 | Sekozawa et al. | 123/480 |
| 4,817,570 | 4/1989 | Morita et al. | 123/486 |
| 4,905,653 | 3/1990 | Manaka et al. | 123/480 |
| 4,919,094 | 4/1990 | Manaka et al. | 123/493 |
| 4,939,658 | 7/1990 | Sekozawa et al. | 123/480 |
| 4,953,530 | 9/1990 | Manaka et al. | 123/492 |

FOREIGN PATENT DOCUMENTS 588238 1/1983 Japan .

*Primary Examiner*—Tony M. Argenbright

*Attorney, Agent, or Firm*—Antonelli, Terry, Stout & Kraus

[57] ABSTRACT

In order to make the quantity of fuel in a cylinder approach a requested value with high accuracy, the characteristic of fuel transport is employed by use of a model in which all injected fuel adheres onto walls of the intake manifold and then a part of the fuel adhering to the walls is sucked off into the cylinder. By use of a respective model for each cylinder, the quantity of fuel injected into each cylinder is independently controlled so that the quantity of fuel in the cylinder is established to be a requested value.

17 Claims, 4 Drawing Sheets

FUEL INJECTION CONTROL METHOD IN AN ENGINE

BACKGROUND OF THE INVENTION

The present invention relates to a controlling of a car engine and, more particularly, relates to a method for controlling fuel injection in an engine, in which the delay in the flow of fuel into a cylinder is compensated to keep the quantity of fuel in the cylinder at a requested value with high accuracy.

In car engines, the delay in transport of fuel occurs because of the phenomenon that injected fuel adheres onto walls of an intake manifold or the phenomenon that fuel adhering on walls of an intake manifold is sucked off into a cylinder. Therefore, it is difficult to correctly keep the quantity of fuel in the cylinder at a requested value. To solve this problem, a method as disclosed in Japanese Patent Unexamined Publication No. JP-A-58-8238 has been proposed. According to this proposed method, the quantity of fuel adhering on walls of an intake manifold and the quantity of fuel sucked off into the cylinder from the adhering fuel (hereinafter called "fuel film") are estimated to thereby determine the quantity of fuel supply to keep the quantity of fuel in the cylinder at a requested value.

In an engine of a multi-point fuel injection system in which fuel injection is made considerably before an air-intake stroke (about 90° crank angle before), it can be well considered that all injected fuel stagnates in an intake manifold because fuel injection is terminated before the start of air-intake stroke, in a low or middle revolution speed of the engine. Then, some percent of the stagnant fuel flows into the cylinder in the air-intake stroke. The residual part of the stagnant fuel remains as new stagnant fuel in the intake manifold.

Another method for compensating the delay of the fuel flow by means of a mathematical model of the fuel system has been presented in Japanese Patent Application Laid-open No. 61-126337 and the corresponding U.S. Pat. No 4,939,658 issued on Jul. 3, 1990 and the corresponding European Patent No. 184,626 issued on Jan. 10, 1990.

The conventional technique is constructed on the assumption that some percent of injected fuel always reaches the cylinder. In short, the conventional technique employs a control algorithm in which such flow of fuel is compensated. Therefore, a problem arises in that the delay of fuel caused by stagnancy of all the injected fuel in the intake manifold cannot be compensated.

To keep the quantity of fuel in the cylinder at a requested value, actual fuel injection time must be determined under the consideration of both the phenomenon of adhesion of injected fuel and the phenomenon of sucking off of a part of the fuel film into the cylinder. However, in the conventional technique, actual fuel injection time is determined by subtracting the quantity of sucked-off fuel from the quantity of fuel injection which is determined to keep the quantity of fuel in the cylinder at a requested value under the consideration of only the phenomenon of adhesion of fuel. There arises a problem in that the determination of actual fuel injection time is not rational.

Further, in the multi-point fuel injection system, fuel control must be carried out based on estimation of the quantity of fuel film for each cylinder in order to compensate the transient delay of fuel with high accuracy because the respective cylinders are different from each other in the quantity of fuel film and in the state of the injectors. In the conventional technique, however, the quantity of fuel film only in one cylinder is estimated for all cylinders, and there arises a problem in that the transient delay of fuel cannot be compensated with high accuracy.

Further, in the conventional technique, there is no consideration of the quantity of fuel film for each cylinder. In short, there is no consideration of the difference in the fuel transport characteristic of each cylinder. There arises therefore a problem in that the delay of fuel in some cylinders cannot be compensated with high accuracy in the case where the difference is large.

As described above, a problem in the conventional technique arises in that the quantity of fuel in each cylinder cannot be kept at a requested value though the characteristic of the delay in transport of fuel may be considered.

SUMMARY OF THE INVENTION

An object of the present invention is therefore to provide a method for controlling fuel injection in an engine, in which the quantity- of fuel in each of all the cylinders can be kept at a requested value independently of other cylinders to thereby solve the aforementioned problems.

To attain the aforementioned object, the flow of fuel is formulated as a lumped constant type numeric model for each cylinder on the assumption that all injected fuel stagnates in the intake manifold and then some percent of the stagnant fuel enters into the cylinder in an air-intake stroke after fuel injection. The sucking-off rate expressing the rate of sucking off of the stagnant fuel into the cylinder as a parameter in the model is obtained experimentally for each cylinder.

Further, fuel control for each cylinder is carried out according to the numeric model obtained as described above so that the quantity of fuel in the cylinder is established to be a requested value.

In the aforementioned method, a numeric model suitable to the real phenomenon is constructed to perform fuel control for each of all the cylinders separately from the other ones by using the model as a fuel transport model. Accordingly, the quantity of fuel supplied to each of all the cylinders can be kept at a requested value separately from the other cylinders.

BRIEF DESCRIPTION OF THE DRAWINGS

Other features and advantages of the present invention will be apparent from the following description taken in connection with the accompanying drawings, wherein.

DESCRIPTION OF THE PREFERRED EMBODIMENTS

Figure 1:
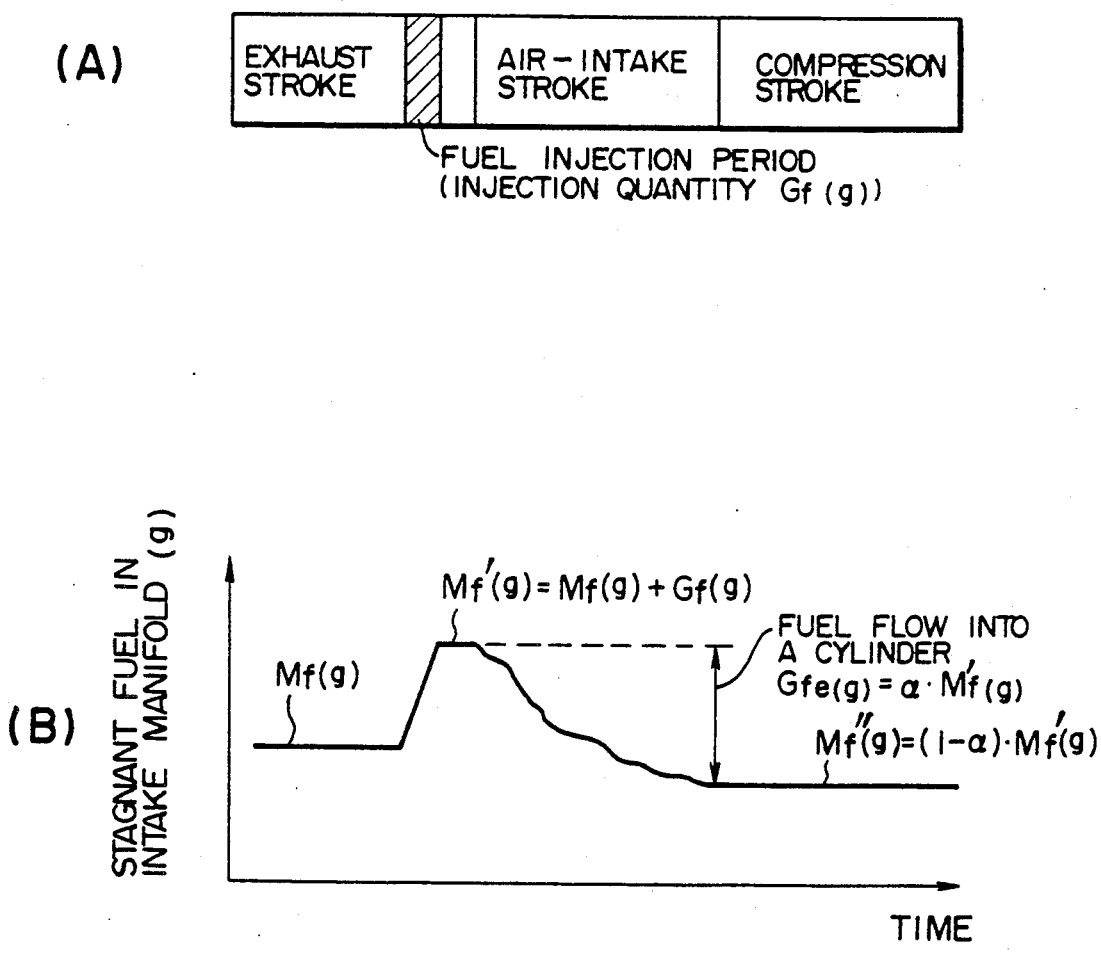
FIG. 1(A) and 1(B) are a view for explaining the change of stagnant fuel in an intake manifold and the flow of fuel according to the present invention.

FIG. 1 is a view showing the change of stagnant fuel in an intake manifold in the case where a certain cylinder is observed in the present invention. The affect of the invention on the flow of fuel and the change of stagnant fuel will be now described with reference to FIG. 1.

Let $M_f(i)$ be stagnant fuel (g) in an exhaustion stroke before fuel injection, in the fuel cycle of an engine. Let $G_f(i)$ be injection fuel (g). Assuming now that injection fuel stagnates entirely in the intake manifold, then stagnant fuel $M'_f(i)$ after fuel injection is represented by the following equation.

$$M'_f(i)=M_f(i)+G_f(i) \tag{1}$$

Assuming that $\alpha\%$ of the stagnant fuel $M'_f(i)$ is sucked off into the cylinder in an air-intake stroke after the fuel injection, then stagnant fuel $G_{fe}(i)$ in an intake manifold is represented by the following equation.

$$G_{fe}(i)=\alpha\cdot M'_f(i) \tag{2}$$

Further, stagnant fuel $M''_f(i)$ in a compression stroke after the air-intake stroke is represented by the following equation.

$$M''_f(i)=(1-\alpha)M'_f(i) \tag{3}$$

The stagnant fuel does not change before the next fuel injection period. In short, the flow of fuel after the next fuel injection is developed in the same manner as described above.

In the present invention, a lumped-constant numerical model given by the equations (1), (2) and (3) is used as a fuel transport model.

The sucking-off rate $\alpha$ as a parameter changes according to the operation condition of the engine. In the case where cylinders are different in the characteristic of fuel transport, the rate $\alpha$ can take different values for the respective cylinders in one operation condition of the engine.

The characteristic of the sucking-off rate $\alpha$ for each cylinder is formulated as follows.

The air-intake quantity, the engine revolution speed, the water temperature and the intake manifold inner pressure are considered as engine state variables affecting the sucking-off rate $\alpha$. Therefore, the sucking-off rate $\alpha$ is calculated so that the measured value thereof obtained from the response of the air-fuel ratio in each cylinder when fuel supply quantity is changed in a predetermined condition with these variables considered to be constant can coincide with the simulation value thereof estimated by using the equations (1), (2) and (3). Thus, a model suitable to the actual phenomenon is constructed. The aforementioned calculation of $\alpha$ is applied to various engine operation states so that the characteristic of $\alpha$ is formulated as a function of operation state variables (the suction air quantity, the engine revolution speed, the water temperature and the intake manifold inner pressure).

In practice, the calculation of the response of the air-fuel ratio is as follows.

The flow of fuel given by the equations (1), (2) and (3) can be represented by the following equations:

$$G_{fe}(i)=\alpha\cdot(M_f(i)+G_f(i)) \tag{4}$$

$$M_f(i+1)=(1-\alpha).(M_f(i)+G_f(i)) \tag{5}$$

in which $M_f(i)$ represents stagnant fuel in an exhaust stroke before fuel injection, in a certain cycle (i-th cycle), $G_f(i)$ represents injected fuel, and $G_{fe}(i)$ represents fuel sucked off into a cylinder.

The response of fuel $G_{fe}(i)$ sucked off into the cylinder when $G_f(i)$ is changed in a predetermined condition can be obtained by repeated calculation of the equations (4) and (5). The response of the air-fuel ratio can be obtained by dividing the measured value of cylinder suction air quantity $Q_a$ by the calculated value thereof. By comparison between the calculated response and the measured response, $\alpha$ is estimated. In the case where a sensor for measuring the air-fuel ratio has a large, response delay, it is necessary to consider the delay for the calculation of $\alpha$. In this case, the response delay of the sensor is formulated in advance on the supposition of suitable transmission characteristic. The calculation of $\alpha$ is carried out based on comparison between the response of the air-fuel ratio corrected by applying the delay process to the calculated response of the air-fuel ratio and the measured response thereof.

For example, assuming that the response delay is a linear delay, then the response characteristic is represented by the following discrete equation:

$$A/F_{out}(i+1)=\left(1-\frac{\Delta t}{T}\right)\cdot A/F_{out}(i)+\frac{\Delta t}{T}\cdot A/F_{in}(i) \tag{6}$$

In the equation (6), $A/F_{out}$: air-fuel ratio output of the sensor $A/F_{in}$: air-fuel ratio input of the sensor i: time (corresponding to cycle number)

T: time constant $\Delta t$: period corresponding to one discrete time

The response of the air-fuel ratio $A/F_{out}$ in due consideration of the response delay of the sensor is obtained based on the equation (6) using the air-fuel ratio calculated based on the equations (4) and (5) as $A/F_{in}(i)$ The characteristic of $\alpha$ may be formulated by estimating $\alpha$ as follows.

The relational equation of $G_f$ and $G_f$ is obtained by eliminating $M_f$ from the equations (4) and (5).

$$G_{fe}(i+1)-(1-\alpha)\cdot G_{fe}(i)=\alpha\cdot G_f(i+1) \tag{7}$$

When the mass of air sucked into the cylinder is replaced by $Q_a$, the fuel-air ratio F/A(i) in the cylinder is represented by the following equation.

$$F/A(i)=\frac{G_{fe}(i)}{Q_a} \tag{8}$$

From the equations (7) and (8), the relationship between the fuel supply $G_f$ and the fuel-air ratio F/A in the cylinder is obtained as follows.

$$F/A(i+1)-(1-\alpha)\cdot F/A(i)=\frac{\alpha}{Q_a}\cdot G_f(i+1) \tag{9}$$

When the fuel-air ratio F/A is measured while the suction air quantity, the revolution speed, the water temperature and the intake manifold inner pressure as variables dependent to $\alpha$ are kept constant and $G_f$ is changed under a predetermined condition, $\alpha$ in which the error (model error) of the equation (9) is minimized can be obtained by using the time-series data of $G_f$ and F/A.

In short, when the estimation index J is represented by the following equation (10), $\alpha$ in which J takes its minimum is represented by the following equation (11).

$$J = \sum_i \left( F/A(i+1) - (1-\alpha)\cdot F/A(i) - \frac{\alpha}{Q_a}\cdot G_f(i+1) \right)^2 \quad (10)$$

$$\alpha = \frac{\sum_i \left( F/A(i) - \frac{G_f(i+1)}{Q_a} \right)^2}{\sum_i (F/A(i+1) - F/A(i)) \cdot \left( F/A(i) - \frac{G_f(i+1)}{Q_a} \right)} \quad (11)$$

The fuel-air ratio F/A(i) in the i-th cycle is obtained as the reciprocal of the value A/F(i) measured with an air-fuel ratio sensor provided in an exhaust pipe.

In the case where the response delay of the air-fuel ratio sensor is large, calculation is carried out as follows.

The response characteristic of the sensor is formulated into a suitable transmission function of the fuel-air ratio. For example, when the delay is linear, the transmission characteristic is represented by the following discrete equation.

$$F/A_{out}(i+1) = \left(1 - \frac{\Delta t}{T'}\right)\cdot F/A_{out}(i) + \frac{\Delta t}{T'}\cdot F/A_{in}(i) \quad (12)$$

In the equation (12), $F/A_{out}$: output fuel-air ratio of the sensor $F/A_{in}$: input fuel-air ratio of the sensor i: time T': time constant $\Delta t$: period corresponding to one discrete time When $\Delta t$ in the equation (12) and F/A in the equation (9) are respectively replaced by a period of one cycle in the engine and $F/A_{in}$ in order to adjust the time in the equation (9) to the time in the equation (12) in the aforementioned discrete system, the relationship between the fuel supply $G_f$ and the output fuel-air $F/A_{out}$ of the sensor is obtained from the equations (9) and (12) to be represented by the following equation.

$$F/A_{out}(i+2) - \left\{ \left(1 - \frac{\Delta t}{T'}\right) + (1-\alpha) \right\} F/A_{out}(i+1) + (1-\alpha)\cdot\left(1 - \frac{\Delta t}{T'}\right)\cdot F/A_{out}(i) = \frac{\Delta t}{T'}\cdot\frac{\alpha}{Q_a}\cdot G_f(i+1) \quad (13)$$

Because the equation (13) is linear with respect to $\alpha$, $\alpha$ in which the equation error is minimized can be obtained in the same manner as described above.

When values of $\alpha$ corresponding to various values of the suction air quantity, the revolution speed, the water temperature and the intake manifold inner pressure are calculated by the aforementioned method, the characteristic of $\alpha$ is formulatd as a function of these variables.

In the case where the present invention is applied to a digital control unit, the characteristic of $\alpha$ is stored as fixed data in an ROM in the form of a map of the suction air quantity, the revolution speed, and the like.

Because at least four variables as described above depend on $\alpha$, it is ideal from the viewpoint of security of accuracy of $\alpha$ that the map has four or more dimensions. However, the area of the ROM required for storage of map data increases as the number of dimensions in the map increases. Accordingly, it may be difficult to store all data in a 256-Kbyte ROM generally used for engine control.

In this case, a reduction of map data can be made as follows.

Variables dependent on $\alpha$, that is, the suction air quantity $Q_a$. the revolution speed N, the water temperature $T_w$ and the intake manifold inner pressure $P_H$, are rearranged as $x_1$, $x_2$, $x_3$ and $x_4$ in the order of contribution to the sucking-out rate $\alpha$.

For example, $\alpha$ is calculated from the map of these variables according to the following equations.

$$\alpha = f_1(x_1, x_2, x_3)\cdot f_2(x_4) \quad (14)$$

$$\alpha = f_3(x_1, x_2)\cdot f_4(x_3)\cdot f_5(x_4) \quad (15)$$

In the equations, $f_1$ is a value obtained by searching a three-dimensional map of respective variables, $f_3$ is a value obtained by searching a two-dimensional map of respective variables, and $f_2$, $f_4$ and $f_5$ are values obtained by searching one-dimensional maps of respective variables.

Data in respective maps are determined as follows.

The following equation is obtained by solving the equation (14) with respect to $f_1$.

$$f_1(x_1, x_2, x_3) = \frac{\alpha}{f_2(x_4)} \quad (16)$$

Accordingly, when the value of $\alpha$ calculated when one variable $x_4$ is kept constant and the other variables $x_1$, $x_2$ and $x_3$ are changed is replaced by $\alpha_1(x_1, x_2, x_3)$, $f_1(x_1, x_2, x_3)$ is calculated according to the following equation.

$$f_1(x_1, x_2, x_3) = m_1 = m_1\cdot\alpha_1(x_1, x_2, x_3) \quad (17)$$

In the equation, $m_1$: constant

Similarly, $f_2(x_4)$ is calculated according to the following equation.

$$f_2(x_4) = m_2\cdot\alpha_2(x_4) \quad (18)$$

In the equation, $m_2$ constant $\alpha_2(x_4)$ the value of $\alpha$ calculated when $x_1$, $x_2$ and $x_3$ are respectively fixed to certain values and $x_4$ is changed In order to determine map data $f_1$ and $f_2$ from the equations (17) and (18), the values of $m_1$ and $m_2$ must be determined.

The values of $m_1$ and $m_2$ are selected so that the value of $\alpha$ calculated by using the equations (14), (17) and (18) for certain values of $x_1$, $x_2$, $x_3$ and $x_4$ coincides with the true value of $\alpha$ for these variables. The values of $m_1$ and $m_2$ cannot be determined monolithically. Therefore, a certain set of values satisfying the aforementioned condition can be used.

Map data in the equation (15) can be calculated in the same manner as described above.

Although the sucking-off rate $\alpha$ calculated by using the equations (14) and (18) for the suction air quantity, the revolution speed, the water temperature and the intake manifold inner pressure may be more or less different from the true value of $\alpha$ calculated by using the equation (11), a reduction of map data can be attained by using maps having a small number of dimensions In the following, a fuel control method using the fuel transport model obtained as described above is considered.

To use fuel sucked off into a cylinder as a request value, that is, to attain a necessary air-fuel ratio, fuel supply is determined for fuel control so that the ratio of the cylinder inflow air quantity to the fuel sucked off into the cylinder is obtained as a desired value (target air-fuel ratio). When the suction air flow quantity and the revolution speed in the i-th cycle are replaced by $Q_a(i)$ and N (rpm), the mass $Q_a'$ (g) of cylinder inflow air is represented by the following equation.

$$Q_a'(i) = k \cdot \frac{Q_a(i)}{N} \tag{19}$$

In the equation,

K: constant.

Accordingly, a desired air-fuel ratio can be attained when the following equation is established.

$$G_{fe}(i) = \frac{k \cdot \frac{Q_a(i)}{N}}{A/F} \tag{20}$$

In the equation, A/F represents target air-fuel ratio.

From the equations (4) and (20), fuel supply $G_f(i)$ in the i-th cycle is represented by the following equation.

$$G_f(i) = \frac{1}{\alpha} \cdot \frac{k \cdot \frac{Q_a(i)}{N}}{A/F} - M_f(i) \tag{21}$$

Figure 2:
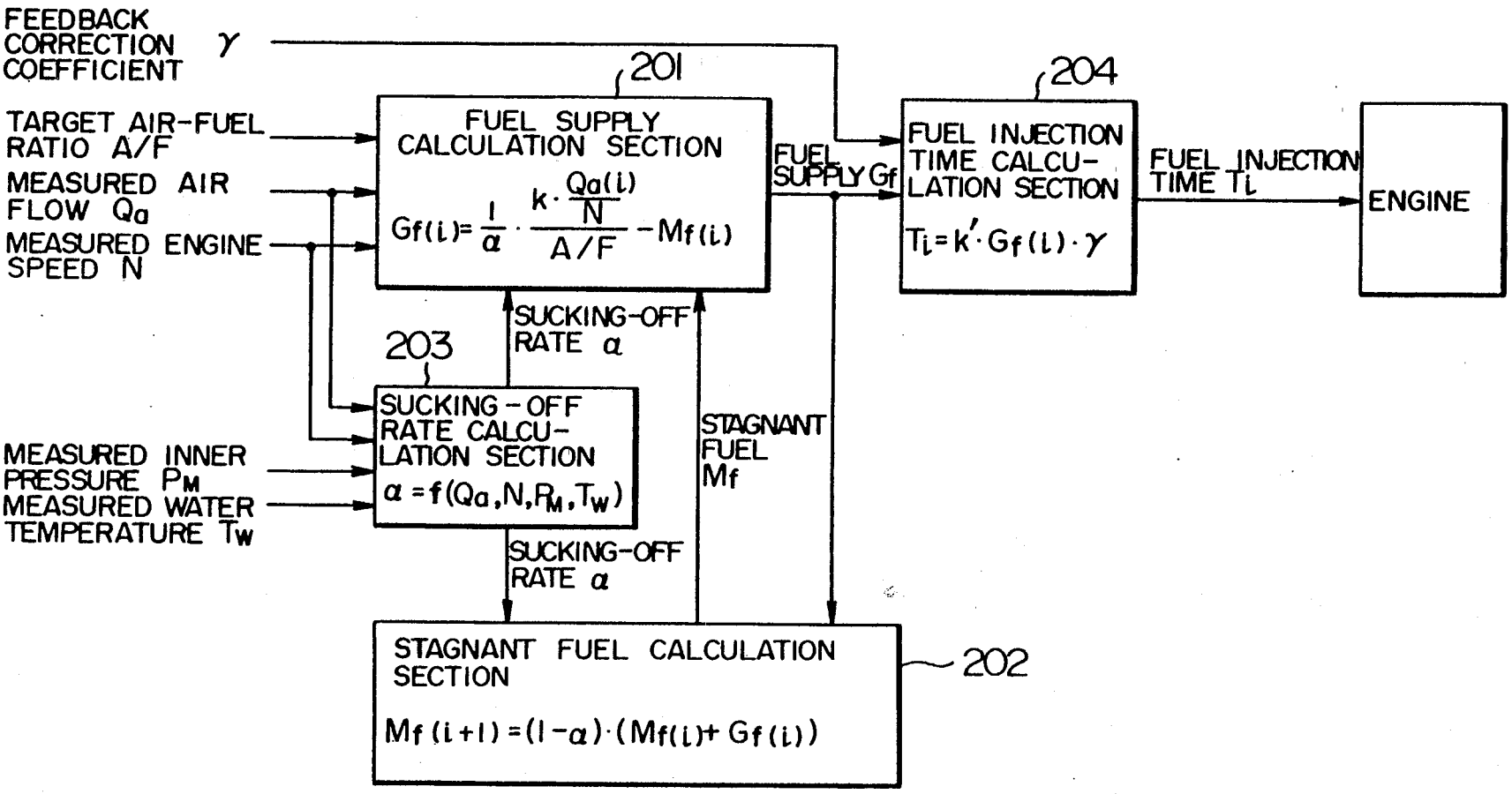
FIG. 2 is a block diagram of a control system in which the delay in transport of fuel is compensated.

FIG. 2 is a schematic block diagram of the whole configuration of the fuel control system according to the present invention in a certain cylinder.

In the block 201, fuel supply $G_f(i)$ in the i-th cycle is calculated according to the equation (21) from the measured value of revolution speed N, the calculated value of sucking-off rate $\alpha$ and the calculated value of stagnant fuel $M_f(i)$ sucked in the intake manifold. In the block 203, the sucking-off rate $\alpha$ is calculated from the measured values of the air flow quantity, the revolution speed, the inner pressure and the water temperature according to the function obtained by the aforementioned method. In the block 202, stagnant fuel $M_f(i)$ used for determination of fuel supply is updated based on the equation (5).

The fuel injection time (pulse width) $T_1$ is calculated from fuel supply based on the following equation to thereby perform fuel control in the engine.

$$T_i = k' \cdot G_f(i) \cdot \gamma + T_s \tag{22}$$

In the equation (22), k' represents a constant, $\gamma$ represents a feedback correction coefficient, and $T_s$ represents an ineffective injection period.

Figure 6:
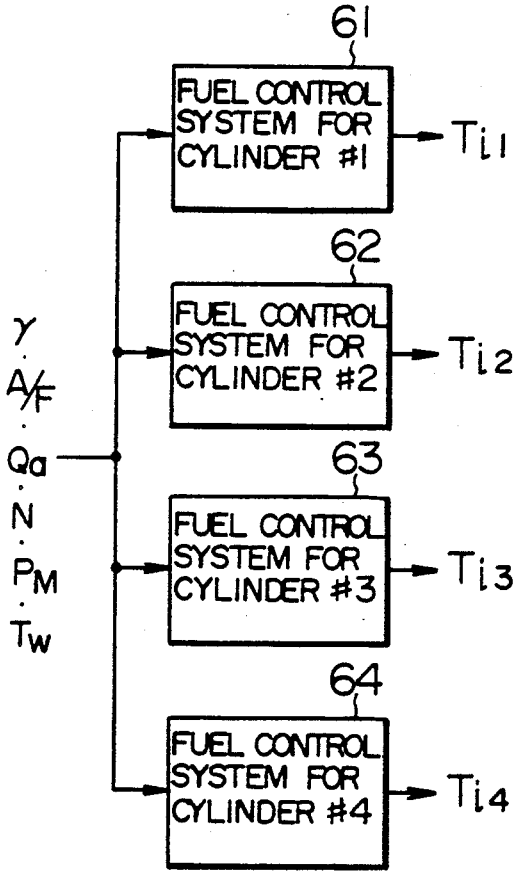
FIG. 6 is a block diagram showing the whole configuration of control systems in a 4-cylinder engine.

In a multi-cylindered engine, the control system as shown in FIG. 2 is provided for each cylinder to perform independent fuel control in each cylinder. For example, in the case of a 4-cylinder engine, the total construction of respective control systems is as shown in FIG. 6. In short, the control systems as shown in FIG. 2 are provided as the blocks 61 to 64 in FIG. 6. It is a matter of course that variables $G_f$, $M_f$ and $\alpha$ used in each of the control systems are established independently in the respective cylinders.

In the case where the respective cylinders are clearly different in the characteristic of $\alpha$, the characteristic of $\alpha$ is established correspondingly to each cylinder. On the contrary, in the case where the respective cylinders are the same in the characteristic of $\alpha$, the same characteristic of $\alpha$ may be established.

In the following, the construction of the control system and the operation of the control program in the case where the aforementioned fuel control method is applied to a digital control unit are described with reference to FIGS. 3 through 5.

Figure 3:
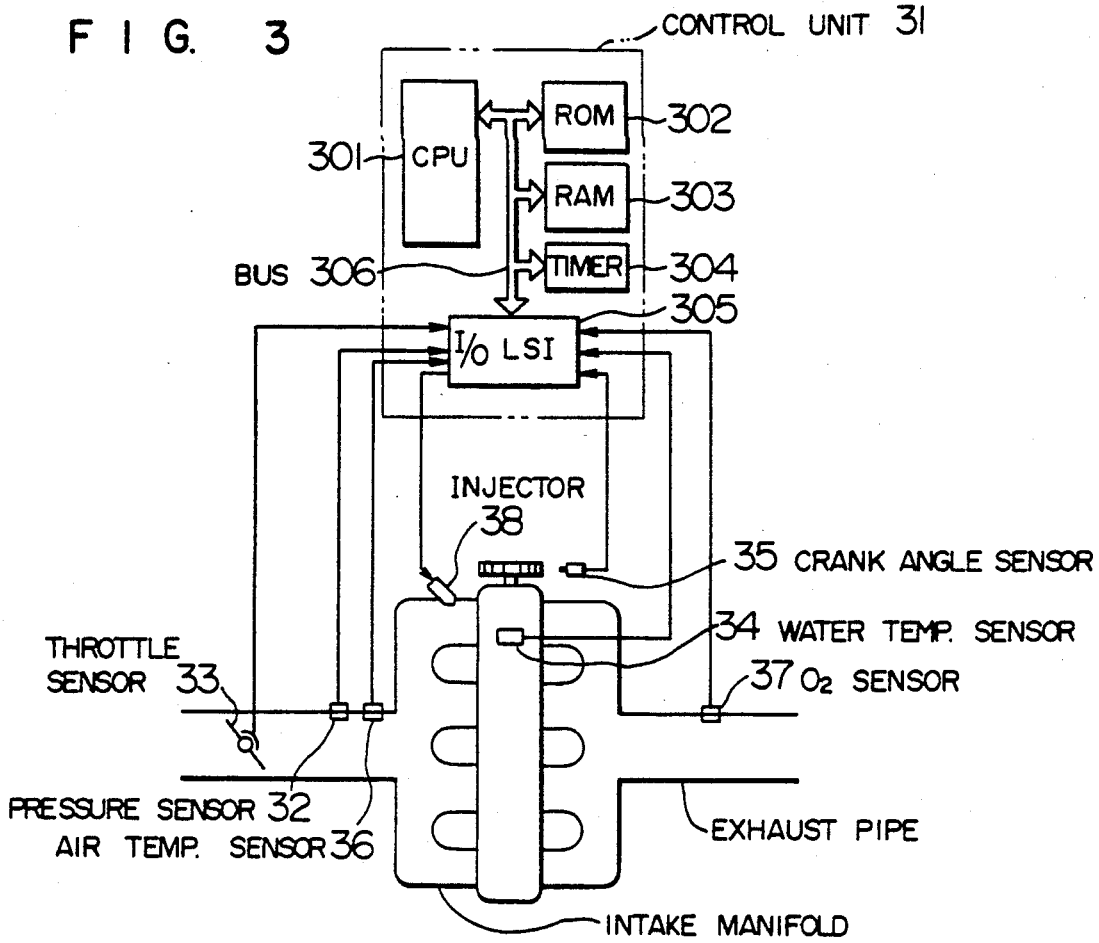
FIG. 3 is a schematic view showing construction of a digital control unit for attaining the fuel transport delay compensating method according to the present invention.

FIG. 3 is a view showing the whole configuration of a D-jetronic system for indirectly detecting an air flow quantity based on the measured values of the intake manifold inner pressure and the revolution speed according to the present invention.

The control unit 31 has a CPU 301, and ROM 302, an RAM 303, a timer 304, an I/O LSI 305, and a bus 306 for electrical connection thereof. The timer 304 generates interrupt requests for the CPU 301 at a predetermined period. The CPU 301 executes the control program stored in the ROM 302 in response to the interrupt requests. Signals from a pressure sensor 32, a throttle angle sensor 33, a water temperature sensor 34, a crank angle sensor 35, a suction air temperature sensor 36 and an oxygen sensor 37 are inputted into the I/O LSI 305. An output signal from the I/O LSI 305 is fed to an injector 38.

In the following, the operation of the control program stored in the ROM 302 is described with reference to FIGS. 4 and 5. FIG. 4 is a flow chart of the control program for calculating the fuel injection time, and FIG. 5 is a flow chart of the control program for calculating stagnant fuel in the intake manifold.

Figure 4:
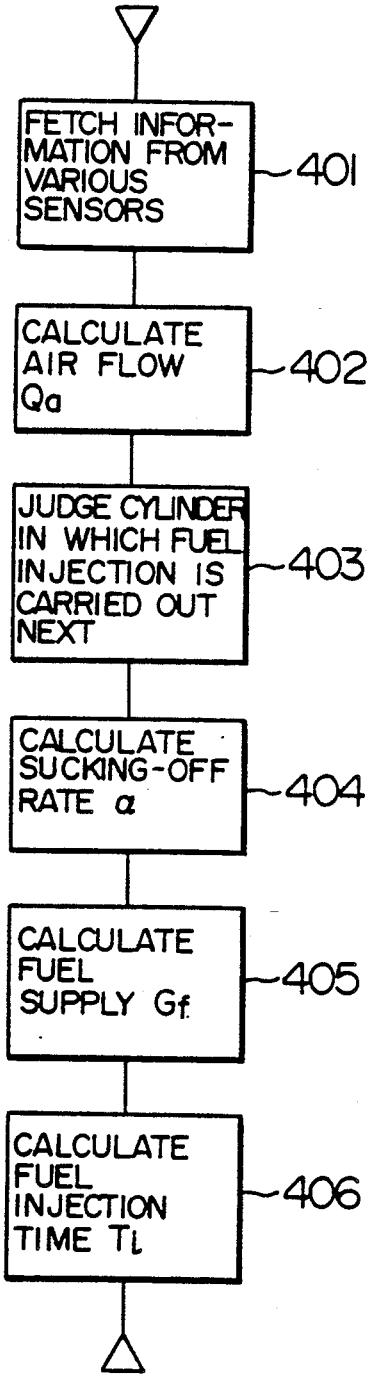
FIG. 4 is a flow chart of a control program for calculating fuel injection time.

Referring now to FIG. 4, in the step 401, signals from the pressure sensor, water temperature sensor, crank angle sensor and suction air temperature sensor are taken in when interrupt requests generated at intervals of 10 msec are given. Revolution count is calculated from the signal of the crank angle sensor.

Then, in the step 402, the suction air flow quantity $Q_a$ in the engine is calculated based on a predetermined equation from the values of the intake manifold inner pressure, the revolution speed and the suction air temperature which have been taken in.

In the step 403, the next cylinder to be subjected to fuel injection is judged.

In the step 404, the sucking-off rate $\alpha$ corresponding to the next cylinder to be subjected to fuel injection is calculated according to a fixed equation from the values of the intake manifold inner pressure, the revolution speed and the water temperature fetched in the step 401 and the value of the air flow quantity calculated in the step 402 and is stored in a predetermined address of the RAM.

In the step 405, the fuel supply $G_f$ for the next cylinder to be subjected to fuel injection is calculated according to the equation (21) from the revolution speed N fetched in the step 401, the air flow quantity $Q_a$ calculated in the step 402, the sucking-off rate $\alpha$ calculated in the step 404, the stagnant fuel $M_f$ (corresponding to the next cylinder to be subjected to fuel injection) calculated by another program and stored in the RAM 303, and the target air-fuel ratio A/F.

Finally, in the step 406, the fuel injection time $T_i$ corresponding to the next cylinder to be subjected to fuel injection is calculated according to the equation (22) from the fuel supply calculated in the step 405. Thus, the series of procedures is terminated to wait for the next interrupt request. As described above, the load imposed on the micro-computer can be reduced by calculating the fuel supply corresponding to the next cylinder to be subjected to fuel injection without calculating the fuel supply for all the cylinders.

Fuel injection is carried out by feeding to the injection a pulse signal corresponding to the fuel injection time calculated in the step 406 in response to the interrupt request expressing that the crank angle has come to a predetermined position.

Figure 5:
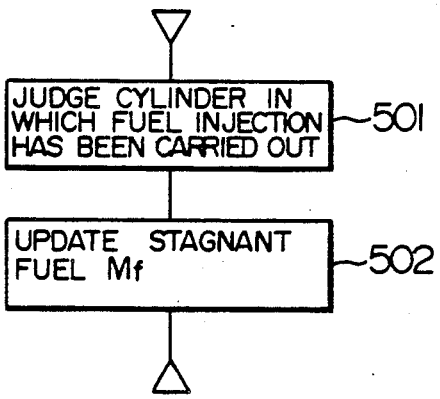
FIG. 5 is a flow chart of a control program for estimating the quantity of stagnant fuel.

The control program for estimating stagnant fuel and updating it as shown in FIG. 5 is executed after fuel injection. In FIG. 5, the cylinder subjected to fuel injection is judged in the step 501. Then, in the step 502, stagnant fuel $M_f(i+1)$ used for calculation of fuel supply $G_f(i+1)$ for the cylinder in the $(i+1)$-th cycle is calculated according to the equation (5) from the stagnant fuel $M_f(i)$ before the fuel injection in the i-th cycle with respect to the cylinder subjected to fuel injection, the fuel supply $G_f(i)$ for the cylinder and the sucking-off rate $\alpha$ used for the calculated of $G_f(i)$ and the result is stored in the RAM 303 in FIG. 3. Thus, the series of procedures is terminated. As described above, stagnant fuel corresponding to the cylinder subjected to fuel injection is updated after the fuel injection.

Although the embodiment has shown the case where the invention is applied to a D-jetronic system, it is to be understood that the invention can be applied to an L-jetronic system in which suction air quantity is detected directly. In the L-jetronic system, the inner pressure in the intake manifold is not detected but this variable can be replaced by the basic injection pulse width.

As described above, in the present invention, a fuel transport model suitable to the real phenomenon is constructed to thereby perform fuel control separately for each cylinder. Accordingly, values requesting fuel for the respective cylinders can be held in all the cylinders. Accordingly, high-accuracy air-fuel ratio control can be made to thereby attain an improvement in exhaust gas cleaning property, operating property and efficiency in fuel cost.

In the prior art, two parameters of adhesion rate and sucking-off rate must be formulated based on experiments for the design of control system. On the contrary, the system according to the present invention can be constructed by formulating one parameter, so that the number of development processes can be reduced.

What is claimed is:

1. An engine fuel injection control method for controlling fuel injection based on the quantity of suction air, said method comprising the step of determining the quantity of fuel injection $G_f$ in the current cycle by an equation of $$G_f = \frac{1}{\alpha} \cdot \frac{Q_a}{A/F} - M_f$$

in which $Q_a$ represents the mass of suction air, $M_f$ represents the quantity of stagnant fuel in an intake manifold, $\alpha$ represents the rate of sucking off stagnant fuel into a cylinder in an air-intake stroke, and A/F represents a target air-fuel ratio.

2. An engine fuel injection control method according to claim 1, in which the step of determining includes the step of calculating the quantity of stagnant fuel $M_f'$ used for calculation of the quantity of fuel injection in the next cycle, by the following equation using $M_f$, $\alpha$ and $G_f$:

$$M_f' = (1-\alpha)\cdot(M_f + G_f).$$

3. A method of controlling fuel injection amount of a multi-point fuel injection system in an multi-cylinder engine, comprising the steps of:

providing a fuel transportation model for each cylinder of the engine, each fuel transportation model defining a fuel transportation condition in an inlet manifold for the respective cylinder;

estimating a transported fuel amount into a cylinder via the inlet manifold on the basis of the fuel transportation model for that cylinder using the latest fuel injection amount determined in a former intake stroke of the same cylinder without using a fuel injection amount of any other cylinder; and calculating a fuel injection amount at a present time in said cylinder according to the estimated fuel amount.

4. A method according to claim 3, wherein said estimated fuel amount includes an amount of stagnant fuel which temporarily remains in the inlet manifold.

5. A method according to claim 4, wherein different fuel transportation models are provided for at least two of the cylinders of the engine.

6. A method according to claim 5, wherein said different fuel transportation models have the same model structure and have different parameter values in the same engine operating condition.

7. A method according to claim 4, wherein said fuel transportation model simulates the fuel transport in the intake manifold such that the whole amount ($G_f$) of the injected fuel before an intake stroke is stuck on an inner wall of the intake manifold, and the stagnant fuel amount ($M_f$) is increased by the whole amount ($G_f$) and a part of said stagnant fuel amount is transported into the cylinder at the intake stroke after fuel injection.

8. A method according to claim 3, wherein said latest fuel injection amount is the actual injection amount in the former cycle of the same cylinder.

9. A method according to claim 8, wherein different fuel transportation models are provided for at least two of the cylinders of the engine.

10. A method according to claim 9, wherein said different fuel transportation models have the same model structure and have different parameter values in the same engine operating condition.

11. A method according to claim 8, wherein said calculating of a fuel injection amount is made periodically with a predetermined period.

12. A method according to claim 11, further comprising a step of judging a cylinder in which fuel is to be injected next, said calculation of a fuel injection amount being made for the next cylinder to which fuel is to be injected.

13. A method of controlling fuel injection amount of a multi-point fuel injection system in an multi-cylinder engine, comprising the steps of:

providing a fuel transportation model for each cylinder of the engine, each fuel transportation model defining a fuel transportation condition in an inlet manifold for the respective cylinder;

estimating a stagnant fuel amount (Mf) in an upper stream of a cylinder on the basis of the fuel transportation model for that cylinder using the latest fuel injection amount determined in the former intake stroke of the same cylinder within using a fuel injection amount of any other cylinder; and calculating a fuel injection amount at a present time in said cylinder according to the estimated stagnant fuel amount ($M_f$).

14. A method according to claim 13, wherein different fuel transportation models are provided for at least two of the cylinders of the engine.

15. A method according to claim 14, wherein said two different fuel transportation models have the same model structure and have different parameter values in the same engine operating condition.

16. A method according to claim 13, wherein said fuel transportation model simulates the fuel transport in the intake manifold such that the whole amount ($G_f$) of the injected fuel before an intake stroke is stuck on an inner wall of the intake manifold, and the stagnant fuel amount ($M_f$) is increased by the whole amount ($G_f$) and a part of said stagnant fuel amount is transported into the cylinder at the intake stroke after fuel injection.

17. A method of controlling fuel injection amount of a multi-point fuel injection system in an multi-cylinder engine, comprising the steps of:

determining a ratio between intake air flow and a fuel amount transported into a cylinder from the total of stagnant fuel in an inlet manifold of the cylinder before an intake stroke; and calculating a fuel injection amount at a present time in said cylinder in such a manner that said ratio becomes a predetermined value.

* * * * *